US009300031B2

(12) United States Patent
Hayashi et al.

(10) Patent No.: US 9,300,031 B2
(45) Date of Patent: Mar. 29, 2016

(54) GLASS ANTENNA AND WINDOW GLASS

(71) Applicant: Asahi Glass Company, Limited, Chiyoda-ku, Tokyo (JP)

(72) Inventors: Takuji Hayashi, Tokyo (JP); Satoshi Tokunaga, Tokyo (JP)

(73) Assignee: ASAHI GLASS COMPANY, LIMITED, Tokyo (JP)

( * ) Notice: Subject to any disclaimer, the term of this patent is extended or adjusted under 35 U.S.C. 154(b) by 190 days.

(21) Appl. No.: 14/077,017

(22) Filed: Nov. 11, 2013

(65) Prior Publication Data

US 2014/0071002 A1 Mar. 13, 2014

Related U.S. Application Data

(63) Continuation of application No. PCT/JP2012/061466, filed on Apr. 27, 2012.

(30) Foreign Application Priority Data

May 12, 2011 (JP) ..... 2011-107676

(51) Int. Cl.
*H01Q 1/32* (2006.01)
*H01Q 1/12* (2006.01)
(Continued)

(52) U.S. Cl.
CPC ..... *H01Q 1/1271* (2013.01); *H01Q 1/1278* (2013.01); *H01Q 5/371* (2015.01); *H01Q 7/00* (2013.01); *H01Q 9/42* (2013.01)

(58) Field of Classification Search
CPC ..... H01Q 7/00; H01Q 5/371; H01Q 9/42
USPC ..... 343/713, 712, 711
See application file for complete search history.

(56) References Cited

U.S. PATENT DOCUMENTS 5,923,298 A 7/1999 Miyahara et al.
6,160,518 A 12/2000 Miyahara et al.
(Continued)

FOREIGN PATENT DOCUMENTS

EP 0 847 100 A1 6/1998
EP 1 732 160 A1 12/2006
(Continued)

OTHER PUBLICATIONS

International Search Report received in PCT/JP2012/061466 dated Jul. 10, 2012.
(Continued)

*Primary Examiner* — Hoanganh Le
(74) *Attorney, Agent, or Firm* — Foley & Lardner LLP

(57) ABSTRACT

A glass antenna provided on or in window glass of a vehicle, includes: an antenna conductor including: a first antenna element which is connected to a feed portion and formed into a loop-like shape extending in a first direction; a second antenna element which is formed into an L-like shape by a first partial element which is connected to the first antenna element and extends in the first direction and a second partial element which is connected to the first partial element and extends in a second direction intersecting the first direction at right angles; a third antenna element which is connected to the first antenna element and extends in the second direction on a side where the second partial element extends with respect to the first partial element; and a fourth antenna element which divides the loop of the first antenna element into two loops.

6 Claims, 4 Drawing Sheets

(51) Int. Cl.

| | |
|---|---|
| ***H01Q 7/00*** | (2006.01) |
| ***H01Q 9/42*** | (2006.01) |
| ***H01Q 5/371*** | (2015.01) |

(56) References Cited

U.S. PATENT DOCUMENTS

| | | | | |
|---|---|---|---|---|
| 6,924,771 | B2 | 8/2005 | Li et al. | |
| 2006/0077101 | A1 | 4/2006 | Puente Baliarda et al. | |
| 2007/0091002 | A1 | 4/2007 | Noh | |
| 2008/0158075 | A1* | 7/2008 | Villarroel et al. | 343/713 |
| 2008/0169989 | A1* | 7/2008 | Li et al. | 343/713 |
| 2012/0249382 | A1* | 10/2012 | Tadokoro | 343/713 |

FOREIGN PATENT DOCUMENTS

| | | | |
|---|---|---|---|
| EP | 1 841 007 | A1 | 10/2007 |
| EP | 1 939 978 | A1 | 7/2008 |
| EP | 2 159 872 | A1 | 3/2010 |
| EP | 2 190 057 | A1 | 5/2010 |
| EP | 2 190 058 | A1 | 5/2010 |
| EP | 2 214 254 | A1 | 8/2010 |
| JP | 06-268421 | A | 9/1994 |
| JP | 08-084012 | A | 3/1996 |
| JP | 10-327009 | A | 12/1998 |
| JP | 2000-307321 | A | 11/2000 |
| JP | 2004-072419 | A | 3/2004 |
| JP | 2010-081567 | A | 4/2010 |
| JP | 2010-088057 | A | 4/2010 |
| JP | 2011-087054 | A | 4/2011 |

OTHER PUBLICATIONS

Extended European Search Report dated Nov. 19, 2014 issued in Application No. 12782650.1.

* cited by examiner

GLASS ANTENNA AND WINDOW GLASS

This application is a continuation of PCT Application No. PCT/JP2012/061466, filed on Apr. 27, 2012, which is based upon and claims the benefit of priority from Japanese Patent Application No. 2011-107676 filed on May 12, 2011. The contents of those applications are incorporated herein by reference in its entirety.

TECHNICAL FIELD

The present invention relates to a glass antenna which is provided on or in window glass of a vehicle and a window glass having the glass antenna.

BACKGROUND ART

As the related art, a glass antenna is known which can receive a digital audio broadcasting (DAB) (for example, refer to Patent Documents 1 to 5). DAB uses two different frequency bands of a band III of 174 to 240 MHz and an L band of 1,452 to 1,492 MHz.

PRIOR ART REFERENCE

Patent Document

Patent Document 1: JP-A-10-327009

Patent Document 2: JP-A-2000-307321

Patent Document 3: Specification of U.S. Pat. No. 6,924,771

Patent Document 4: Specification of Unexamined European Patent Application No. 1732160

Patent Document 5: JP-A-2010-81567

SUMMARY OF THE INVENTION

Problems to be Solved by the Invention

With a dual frequency band as in the case of DAB, since bands are widely separated, it is difficult to design a glass antenna having a sufficient reception performance which can deal with both the bands. Further, a glass antenna is desired to deal with a dual frequency band and to have high receive sensitivity. As a glass antenna which can deal with a dual frequency band and which has high receive sensitivity, there is, for example, a glass antenna 50 which is disclosed in Patent Document 5 (refer to FIG. 1).

On the other hand, an AM glass antenna for an AM broadcasting needs to increase its surface area in order to obtain good reception sensitivity. However, when the AM glass antenna and a vertically long glass antenna 50 are provided on or in the same window glass, depending upon a feeding position for the glass antenna 50, there may be a situation in which the required surface area of the AM glass antenna cannot be ensured.

For example, as shown in FIG. 1, since there may be a situation in which a feed portion 56 of the glass antenna 50 is positioned closer to a roof side and further horizontally inwards towards a center than a pillar side of window glass due to a feeding position on a vehicle body being limited, and antenna elements have to be disposed in a position which lies closer to the center of the window glass. In this case, the AM glass antenna is formed only near the center of the window glass, and therefore, a sufficient surface area cannot be ensured for the AM glass antenna. Although a space area 51 where an antenna element of the glass antenna can be disposed can be obtained near the pillar side of the window glass, the vertically long glass antenna 50 interrupts the disposition of the antenna element, and therefore, the surface area of the AM glass antenna 20 cannot be extended to the space area 51.

In the case of FIG. 1, there is considered a way in which the surface area of the AM glass antenna 20 is expanded by extending an element of the AM glass antenna 20 in such a manner as to pass through between an element 52 of the glass antenna 50 and a heater wire 30*a* of a defogger 30 so as to be connected with an antenna element additionally disposed in the space area 51. However, in the event that the AM glass antenna 20 is disposed too close to the defogger 30, there may be fears that the receive sensitivity of the AM glass antenna 20 is reduced. For these reasons, a glass antenna is demanded which is short in height, that is, whose vertical length is short. In addition, with a glass antenna which is short in height, even though the antenna placement area is narrow in a vertical direction for other reasons than those described above, the glass antenna can be disposed, resulting in a highly versatile glass antenna.

Then, an object of the invention is to provide a glass antenna which can deal with a dual frequency band as in DAB, which has high receive sensitivity and whose vertical length is short. In addition, another object of the invention is to provide window glass on or in which the glass antenna is provided.

Means for Solving the Problems

With a view to attaining one of the objects, according to the invention, there is provided a glass antenna provided on or in window glass of a vehicle, characterized by including:

an antenna conductor and a feed portion, the antenna conductor including:

a first antenna element which is connected to the feed portion and which is formed into a loop-like shape extending in a first direction;

a second antenna element which is formed into an L-like shape by a first partial element which is connected to the first antenna element and which extends in the first direction and a second partial element which is connected to the first partial element and which extends in a second direction intersecting the first direction at right angles;

a third antenna element which is connected to the first antenna element and which extends in the second direction on a side where the second partial element extends with respect to the first partial element; and a fourth antenna element which divides the loop of the first antenna element into two loops.

In addition, with a view to attaining the other object, according to the invention, there is provide window glass for a vehicle, including the glass antenna described above.

Effects of the Invention

According to the invention, the glass antenna can be provided which can deal with the dual frequency band as in DAB, which has high receive sensitivity and whose vertical length is short.

MODES FOR CARRYING OUT THE INVENTION

Figure 1:
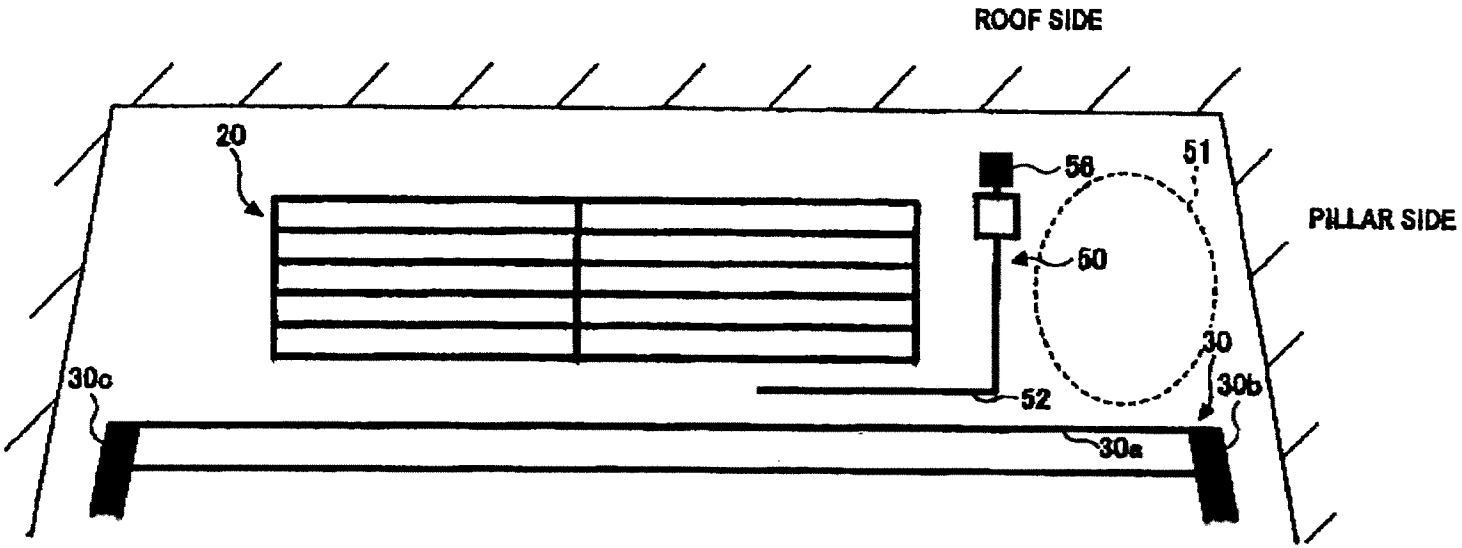
FIG. 1 is a plan view of a conventional glass antenna 50.

Hereinafter, referring to the drawings, a mode for carrying out the invention will be described.

In the drawings which illustrate the mode, when no specific description is made on directions, directions on the drawings should be referred to, and the orientation of each drawing corresponds to those of symbols and numerals given. In addition, parallel and normal directions permit deviations to such an extent that the advantage of the invention is not damaged. Additionally, although the drawings show views of window glass which is set in a window of a vehicle, they may be referred to as views of the window glass as viewed from the outside thereof. For example, when the window glass is rear glass which is set in a rear portion of the vehicle, left-to-right directions on the drawings correspond to widthwise directions of the vehicle. In addition, the window glass according to the invention is not limited to the rear glass, and hence, the window glass may be a windshield which is set in a front portion of the vehicle or side glass which is set in a side of the vehicle.

Figure 2:
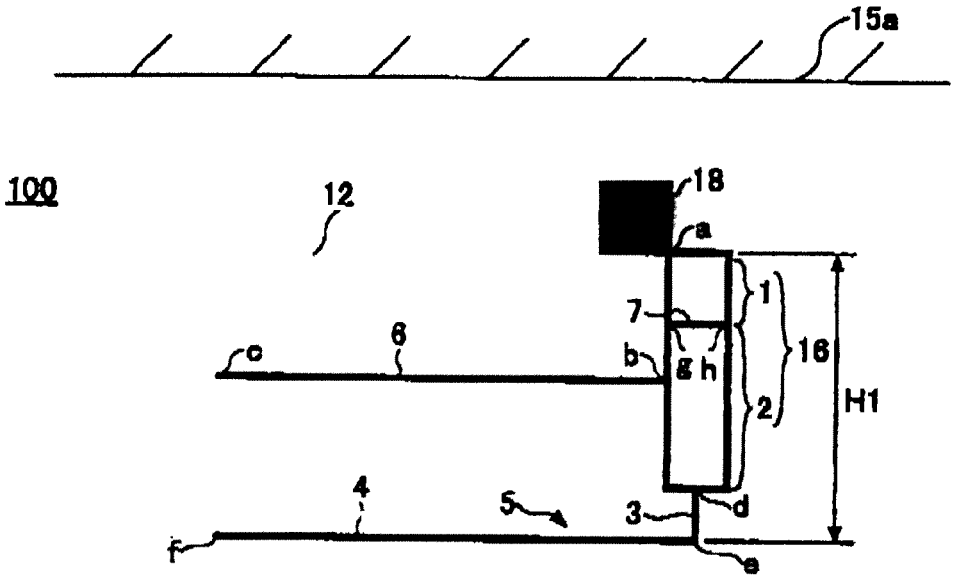
FIG. 2 is a plan view of a glass antenna 100 according to a first embodiment of the invention.

FIG. 2 is a plan view of a vehicle glass antenna 100 according to a first embodiment of the invention. The glass antenna 100 includes a feed portion 18 and an antenna conductor which are provided as a flat pattern on or in vehicle window glass 12.

The feed portion 18 is a portion where the antenna conductor is to be connected to a signal processing circuit, not shown, such as an amplifier. A vehicle body opening edge 15*a* is an end portion of a vehicle body flange which defines a window opening portion in which the window glass 12 is set. The feed portion 18 should be positioned near an edge of the window glass 12 or near the vehicle body opening edge 15*a*.

The glass antenna 100 includes first to fourth antenna elements as a pattern of the antenna conductor.

The first antenna element is connected to the feed portion 18 and is formed into a loop-like shape which extends in a first direction. It is noted that in this embodiment the first direction denotes a vertical direction on the window glass 12 in such a state that the window glass 12 is set in the window opening portion. FIG. 2 shows exemplarily a loop element 16 as the first antenna element. An upper end portion of the loop element 16 is connected directly to a lower end portion a of the feed portion 18. The loop element 16 may be connected to an arbitrary vertical or horizontal end portion of the feed portion 18 via a connecting element. Additionally, the loop element 16 is made up of a rectangular loop whose vertical direction is referred to as a longitudinal direction thereof. The shape of a loop making up the loop element 16 is not limited to the rectangular shape and hence, the loop may be formed into a quadrangular shape such as square or other shapes or may be formed into a circular shape. The loop making up the loop element 16 is divided into two loop portions 1, 2 by a dividing element 7 which will be described later.

The second antenna element is formed into an L-like shape by a first partial element which is connected to a lower side of the first antenna element and which extends in a vertical direction and a second partial element which is connected to the first partial element and which extends in a second direction which intersects the first direction at right angles. In this mode, the second direction denotes a left-to-right direction on the window glass 12 in such a state that the window glass 12 is set in the window opening portion. FIG. 2 shows exemplarily an L-shaped element 5 as the second antenna element. The L-shaped element 5 includes a line element 3 as the first partial element which extends in the vertical direction and a line element 4 as the second partial element which extends in the left-to-right direction. An upper end portion of the line element 3 is connected directly to a lower end portion d of the loop element 16 which makes up part of a lower side thereof. In addition, a right end portion of the line element 4 is connected directly to a lower end portion e of the line element 3. The line element 4 extends leftwards rectilinearly from the lower end portion e as an origin point as far as a left end portion f which makes up a termination point of its leftward extension.

The third antenna element is connected to the first antenna element and which extends in the left-to-right direction on a side where the second partial element extends with respect to the first partial element. FIG. 2 shows a rectilinear horizontal element 6 as the third antenna element. A right end portion of the horizontal element 6 is connected directly to a left end portion b which makes up part of a left side of the loop element 16. In addition, the horizontal element 6 extends in the left-to-right direction on a side where the line element 4 extends with respect to the line element 3. The horizontal element 6 extends leftwards rectilinearly from the left end portion b as an origin point as far as a left end portion c which makes up a termination point of its leftward extension.

The fourth antenna element divides the loop of the first antenna element into two loop portions. FIG. 2 shows a dividing element 7 which extends in the left-to-right direction as the fourth antenna element. The dividing element 7 divides the loop which makes up the loop element 16 into the two loop portions 1, 2. The dividing element 7 is connected to a left end portion g of the loop element 16 which makes up part of the left side of the loop element 16 at a left end thereof and is connected to a right end portion h which makes up part of a right side of the loop element at a right end thereof.

In this way, with the glass antenna 100 formed in the way illustrated in FIG. 2, even though a vertical length H1 of the glass antenna 100 is short, it is possible to obtain good reception properties which can deal with the dual frequency band as in DAB by connecting electrically the feed portion 18 to the signal processing circuit such as an amplifier via a predetermined conductive member. Specifically speaking, receive sensitivity which is equal to or better than the receive sensitivity of the conventional glass antenna 50 shown in FIG. 1 can be obtained with the height H1 of 110 mm or less which is shorter than the length of the glass antenna 50 in the first direction.

In particular, a vertically polarized electric wave of the dual frequency band as in DAB can be received with better receive sensitivity by the loop element 16 extending in the vertical direction being provided on or in the window glass 12 so as to have a vertical component with respect to the ground surface (in particular, a horizontal plane). An angle at which the window glass 12 is set in the vehicle is preferably in the range from 20 to 90° and more preferably in the range from 30 to 90°.

For example, a feeder like such as an AV line or a coaxial cable is used as the conductive member described above. In the case of the coaxial cable being used, an internal conductor of the coaxial cable should be electrically connected to the feed portion 18 and an external conductor of the coaxial cable should be grounded to the vehicle body. In addition, a configuration may be adopted in which a connector which can easily be attached to and detached from the feeder line is mounted on the feed portion 18. By adopting such a connector, the connection of the internal conductor of the AV line or the coaxial cable to the feed portion 18 is facilitated. Further, a signal processing circuit such as an amplifier may be provided integrally with the connector. Additionally, a configuration may be adopted in which a projecting conductive member is placed on the feed portion 18 so as to be brought into contact and fitting engagement with a connecting portion such as a terminal which is connected to a signal processing circuit provided on the flange of the vehicle body on which the window glass 12 is set.

In addition, the "end portion" of the element may be the origin point or termination point of the extension of the element or may be a conductor portion lying just before and near the origin point or termination point. Additionally, the connecting portion between the elements may be such that the elements are connected together thereat in a curved fashion with certain curvature.

Additionally, the antenna conductor and the feed portion 18 are formed by printing and baking a paste including a conductive metal such as sliver paste, for example, on an inner surface of the window glass. However, the invention is not limited to this forming method, and hence, a linear member or a foil member made of a conductive material such as copper may be formed on the inner surface or an outer surface of the window glass, or may be affixed to the window glass with an adhesive, or may be provided in an interior of the window glass itself.

The shape of the feed portion 18 may be determined according to the shape of the conductive member or the shape of a mounting surface of the connector. In mounting the connector on the feed portion 18, for example, a quadrangular shape such as square, substantially square, rectangle or substantially rectangle or a polygonal shape is preferable. Additionally, the feed portion 18 may be formed into a circular shape such as circle, substantially circle, oval or substantially oval.

In addition, a conductor layer made of an antenna conductor may be provided in an interior or on a surface of a synthetic resin film, and the synthetic resin film with the conductor layer may be formed on an inner surface or an outer surface of a window glass pane to form a glass antenna. Further, a flexible circuit board on which an antenna conductor is formed may be formed on the inner surface or outer surface of the window glass to form a glass antenna.

In addition, a concealing film is formed on the surface of the window glass 12 so that the feed portion and part or the whole of the antenna conductor is provided on this concealing film. For the concealing film, ceramics such as a black ceramic film are raised. As this occurs, when looking at the window glass from the outer side thereof, the antenna conductor provided on the concealing film is made invisible from the outside of the vehicle by the concealing film, resulting in the window glass of superior design. In the configuration shown in the figure, the feed portion and part of the antenna conductor are formed on the concealing film (between an edge of the concealing film and the edge of the window glass 12), whereby when looking at the window glass from the outside of the vehicle, only thin rectilinear portions of the conductor are seen, which is preferable in terms of design.

Figure 3:
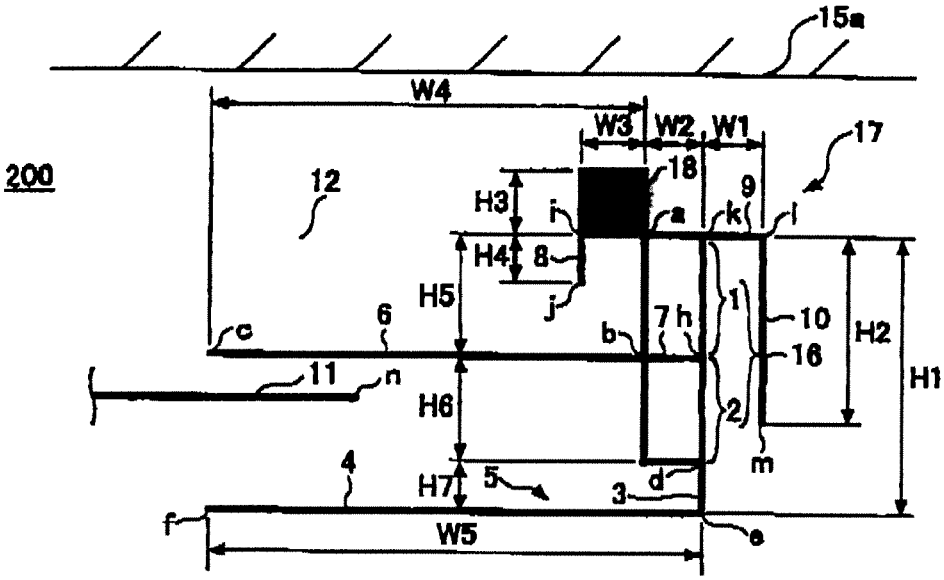
FIG. 3 is a plan view of a glass antenna 200 according to a second embodiment of the invention.

FIG. 3 is a plan view of a glass antenna 200 which is a second embodiment of the invention. The description of like configurations to those of the glass antenna 100 shown in FIG. 2 will be omitted here. In addition to the configuration of the glass antenna 100 shown in FIG. 2, the glass antenna 200 shown in FIG. 3 includes, as part of a pattern of an antenna conductor, an auxiliary vertical element 8 which is added as a fifth antenna element which is connected to a feed portion and which extends in a first direction and an L-shaped element 17 which is added as a sixth antenna element.

Consequently, since the glass antenna 200 has the same configuration as that of the glass antenna 100, even though a vertical length H1 is short, it is possible to obtain good reception properties which can deal with the dual frequency band as in DAB by connecting a feed portion 18 electrically to a signal processing circuit such as an amplifier via a predetermined conductive member.

The auxiliary vertical element 8 is connected to the feed portion 18 and extends in a vertical direction. The provision of the auxiliary vertical element 8 is preferable in enhancing an antenna gain in a high-frequency band of the dual frequency band. For example, in the case of DAB, the provision of the auxiliary vertical element 8 is preferable in enhancing an antenna gain in the L band.

In the case of FIG. 3, an upper end portion of the auxiliary vertical element 8 is connected directly to a left lower end portion i of the feed portion 18 which is different from a lower end portion a thereof. The auxiliary vertical element 8 is a line element which extends in the vertical direction on a side where a horizontal element 6 extends with respect to a loop element 16. The auxiliary vertical element 8 extends downwards rectilinearly from the lower end portion i as an origin point to such an extent that it does not contact the horizontal element 6 and as far as a lower end portion j which is a terminating point of its downward extension.

The L-shaped element 17 is connected to a side of the loop element 16 and is formed into an L shape on an opposite side to a side where a line element 4 extends with respect to a line element 3. The provision of the L-shaped element 17 is preferable in enhancing an antenna gain in a low-frequency band of the dual frequency band. For example, in the case of DAB, the provision of the L-shaped element 17 is preferable in enhancing an antenna gain in the band III.

In the case of FIG. 3, the L-shaped element 17 includes a line element 9 which is a third partial element which extends in the left-to-right direction and a line element 10 as a fourth partial element which extends in the vertical direction. A left end portion of the line element 9 is connected directly to a right end portion k of the loop element 16 which makes up part of a right side thereof. Additionally, an upper end portion the line element 10 is connected directly to a right end portion 1 of the line element 9. The line element 10 extends downwards rectilinearly from the right end portion 1 as an origin point and as far as a lower end portion m which is a terminating point of its downward extension.

In addition, as shown in FIG. 3, the horizontal element 6 and a dividing element 7 may be disposed so that the horizontal element 6 and the dividing element 7 make up a continuous line, that is, a right end portion b and a left end portion g coincide with each other. A good external appearance is provided by this configuration.

Additionally, as shown in FIG. 3, a separate independent conductor pattern which does not use the feed portion 18 as its feeding point is provided between the line element 4 and the horizontal element 6, which is preferable in enhancing the antenna gain in the high-frequency band of the dual frequency band. For example, in the case of DAB, the provision of the separate independent conductor pattern is preferable in enhancing the antenna gain in the L band. In addition, when the independent conductor pattern makes up part of an antenna element of an AM glass antenna, it is preferable not only in expanding the surface area of the AM glass antenna but also in enhancing the antenna gain in the L band.

FIG. 3 shows a linear conductor 11 as an example of an independent conductor pattern like that described above. The linear conductor 11 is an element which extends in the left-to-right direction so that a right end portion n of the linear conductor 11 is positioned in a vertical space area defined between the line element 4 and the horizontal element 6. Although only one linear conductor 11 may be provided, a plurality of linear conductors may be provided.

EXAMPLE

Figure 4:
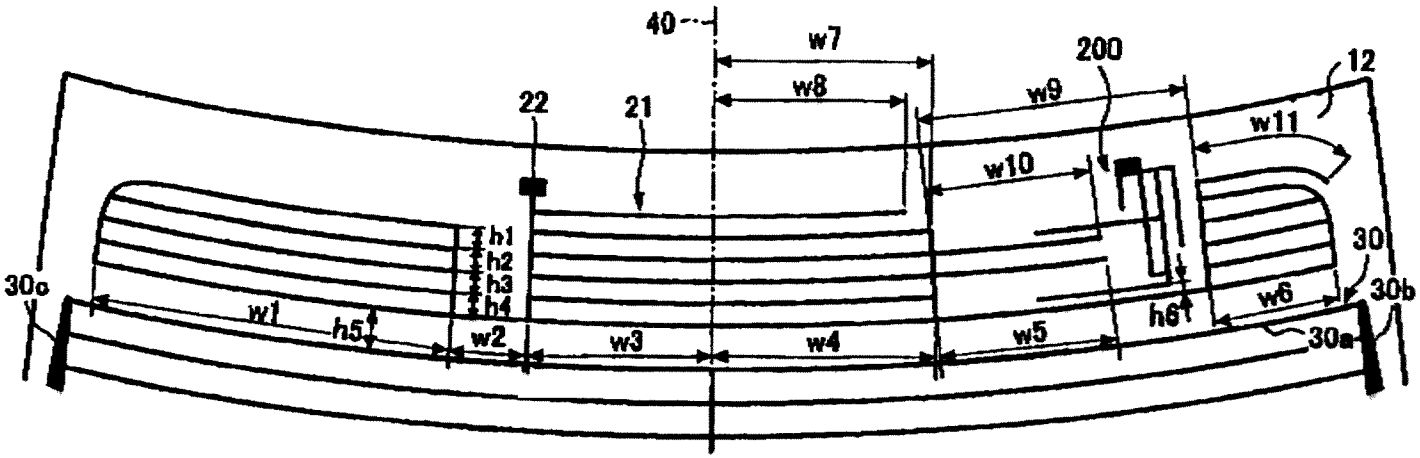
FIG. 4 is a plan view of rear glass 12 on or in which the glass antenna 200 is provided.

A measurement of antenna gains is carried out on a motor vehicle glass antenna which is prepared by setting the form of the glass antenna 200 described above on actual rear glass for a vehicle as shown in FIG. 4, and the results of the measurement will be described below.

Antenna gains are actually measured on the motor vehicle window glass on which the glass antenna is formed by setting the motor vehicle window glass in a window frame of a motor vehicle on a turntable while being inclined at about 25° with respect to a horizontal plane. A connector is mounted on the feed portion for connection with a network analyzer via a feeder line. The turntable rotates so that radio wave is shone on the window glass in every horizontal direction.

A measurement of antenna gains is carried out by setting a vehicle center of the motor vehicle in which the glass on which the glass antenna is formed is set to a center of the turntable and then rotating the turntable 360°. Data on antenna gain is measured at every 3 MHz within a frequency range of the band III and at every 1.7 MHz within a frequency range of the L band every time the turntable rotates 5°. The measurement is carried out with a wave angle between the emitting position of radio wave and the antenna conductors being substantially horizontal (in a direction in which the wave angle is 0° when assuming that the wave angle is 0° at a plane parallel to the ground surface and the wave angle is 90° in a zenithal direction). The antenna gains are standardized so that with a half-wave dipole antenna used as reference, the antenna gain of the half-wave dipole antenna becomes 0 dB.

A defogger 30, an AM glass antenna 21 disposed above the defogger 30 and the glass antenna 200 are provided on the window glass (rear glass) 12 shown in FIG. 4. Further, a feed portion 22 for the AM glass antenna 21 is provided.

The defogger 30 is an energized heating pattern having a plurality of heater wires 30*a* which extend parallel and a plurality of strip-like bus bars 30*b*, 30*c* which feed the heater wires (only an upper side of the pattern is shown while a lower side thereof is omitted in FIG. 4). The defogger 30 is disposed symmetrical with respect to a center line 40 of the window glass (or in a widthwise direction of a vehicle body). The plurality of heater wires are disposed on the window glass 12 so that with the window glass 12 set in the vehicle, the heater wires extend parallel to a horizontal plane (the surface of the ground).

According to the form of the glass antenna 200, the vertical length can be made shorter than that of the conventional glass antenna with the receive sensitivity of the dual frequency band as in DAB kept ensured. Because of this, the AM glass antenna 21 can be extended to pass between a lowermost element of the glass antenna 200 and the defogger 30 as shown in FIG. 4 without the receive sensitivity of the AM glass antenna 21 being reduced due to the AM glass antenna 21 is disposed near the defogger 30.

Figure 5:
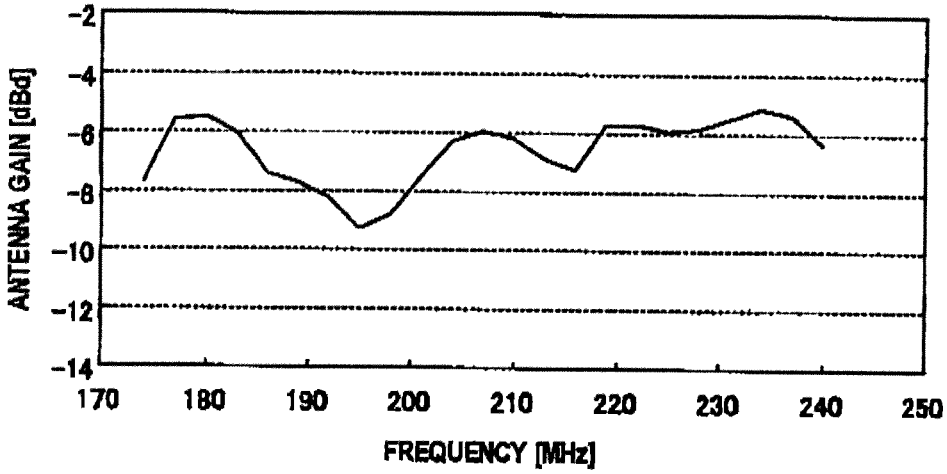
FIG. 5 shows actually measured data of an antenna gain in the band III.
Figure 6:
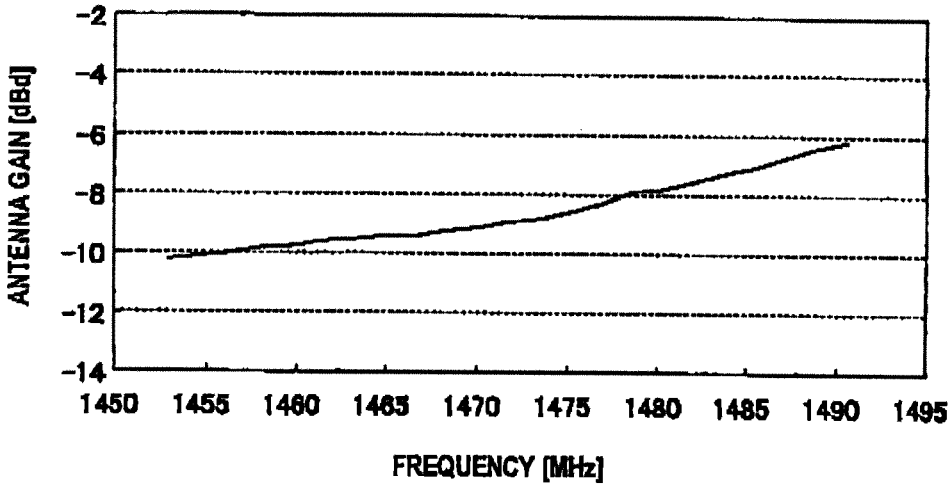
FIG. 6 shows actually measure data of an antenna gain in the L band.

FIGS. 5 and 6 show data resulting from an actual measurement of antenna gains carried out on the glass antenna 200 shown in FIG. 4. An axis of ordinates in FIG. 5 represents a mean value in the band of an antenna gain measured at every 3 MHz in the band III (170 to 240 MHz) every time the glass antenna 200 rotates 5°, and an axis of ordinates in FIG. 6 represents a mean value in the band of an antenna gain measured at every 1.7 MHz in the L band (1452 to 1492 MHz) every time the glass antenna 200 rotates 5°.

When expressed in unit of mm, the dimensions of the respective portions (FIGS. 3, 4) of the glass antennas when they are actually measured for antenna gains to obtain the data shown in FIGS. 5 and 6 are as follows:

H1: 105;
H2: 70;
H3: 12;
H4: 30;
H5: 45;
H6: 50;
H7: 10;
W1: 15;
W2: 15;
W3: 20;
W4: 100;
W5: 120;
h1: 20;
h2: 20;
h3: 20;
h4: 20;
h5: 40;
h6: 10;
w1: 330;
w2: 70;
w3: 170;
w4: 205;
w5: 155;
w6: 115:
w7: 200;
w8: 175;
w9: 245;
w10: 150;
w11: 120.

The width of a conductor of each element is 0.8 mm.

According to the results of the actual measurement shown in FIGS. 5, 6, it is possible to obtain the receive sensitivity which is equal to or better than the receive sensitivity of the conventional glass antenna 50 shown in FIG. 1 with the vertical length of 105 mm, which is shorter than the vertical length of the conventional glass antenna 50.

While the present patent application has been described in detail and by reference to the specific embodiments, it is obvious to those skilled in the art to which the invention pertains that various alterations and modifications can be made thereto without departing from the spirit and scope of the invention.

The present patent application is based on Japanese Patent Application (No. 2011-107676) filed on May 12, 2011, the contents of which are incorporated herein by reference.

DESCRIPTION OF REFERENCE NUMERALS AND SIGNS

1, 2 loop portion;
3, 4 line element;
5 L-shaped element;
6 horizontal element;
7 dividing element;
8 auxiliary vertical element;
9, 10 line element;
11 linear conductor;
12 window glass;

16 loop element;
17 L-shaped element;
18 feed portion;
20, 21 AM glass antenna;
22 feed portion;
30 defogger;
30*b*, 30*c* bus bar;
40 center line;
50 conventional glass antenna;
51 space area;
56 feed portion;
100, 200 glass antenna.

The invention claimed is:

1. A glass antenna provided on or in window glass of a vehicle, comprising:

an antenna conductor and a feed portion, the antenna conductor including:

a first antenna element which is connected to the feed portion and which is formed into a loop-like shape extending in a first direction;

a second antenna element which is formed into an L-like shape by a first partial element which is connected to the first antenna element and which extends in the first direction and a second partial element which is connected to the first partial element and which extends in a second direction intersecting the first direction at right angles;

a third antenna element which is connected to the first antenna element and which extends in the second direction on a side where the second partial element extends with respect to the first partial element;

a fourth antenna element which divides the loop of the first antenna element into two loops, and a sixth antenna element which is connected to the first antenna element and which is formed into an L shape on an opposite side where the second partial element extends with respect to the first partial element.

2. The glass antenna according to claim 1, wherein the antenna conductor includes a fifth antenna element which is connected to the feed portion and which extends in the first direction.

3. The glass antenna according to claim 1, wherein in the antenna conductor, the length of the first direction is 110 mm or less.

4. The glass antenna according to claim 1, wherein another conductor which does not use the feed portion as a feed point is disposed between the second partial element and the third antenna element.

5. The glass antenna according to claim 4, wherein the another conductor is an AM antenna element.

6. A window glass, comprising the glass antenna according to claim 1.

* * * * *